US012582206B1

(12) United States Patent
Nieman

(10) Patent No.: US 12,582,206 B1
(45) Date of Patent: Mar. 24, 2026

(54) BAG CONVERTIBLE BETWEEN FOLDED AND UNFOLDED CONFIGURATIONS

(71) Applicant: Lisa Nentwig Nieman, Raleigh, NC (US)

(72) Inventor: Lisa Nentwig Nieman, Raleigh, NC (US)

( * ) Notice: Subject to any disclaimer, the term of this patent is extended or adjusted under 35 U.S.C. 154(b) by 0 days.

(21) Appl. No.: 19/027,648

(22) Filed: Jan. 17, 2025

(51) Int. Cl.

| | |
|---|---|
| ***A45C 13/12*** | (2006.01) |
| ***A45C 3/00*** | (2006.01) |
| ***A45C 3/06*** | (2006.01) |
| ***A45C 7/00*** | (2006.01) |
| ***A45C 13/10*** | (2006.01) |
| ***A45F 4/02*** | (2006.01) |

(52) U.S. Cl.
CPC ..... *A45C 7/0063* (2013.01); *A45C 3/001* (2013.01); *A45C 3/06* (2013.01); *A45C 13/1069* (2013.01); *A45C 13/1076* (2013.01); *A45C 13/12* (2013.01); *A45F 4/02* (2013.01); *A45C 2013/1015* (2013.01)

(58) Field of Classification Search
CPC ..... A45C 7/0063; A45C 3/001; A45C 3/06; A45C 13/1069; A45C 13/1076; A45C 13/12; A45C 2013/1015; A45F 4/02
USPC ..... 150/110
See application file for complete search history.

(56) References Cited

U.S. PATENT DOCUMENTS

| | | | |
|---|---|---|---|
| 2,038,952 A | 4/1936 | Niedorff | |
| 4,117,874 A | 10/1978 | Berenguer | |
| 5,472,280 A | 12/1995 | Rittmaster | |

FOREIGN PATENT DOCUMENTS

| | | | | |
|---|---|---|---|---|
| CA | 3054865 A1 * | 3/2020 | ..... | A45F 3/04 |
| DE | 202004013940 U1 | 1/2005 | | |
| JP | 2009261877 A | 11/2009 | | |
| JP | 3233693 U | 8/2021 | | |
| KR | 200491788 Y1 | 6/2020 | | |
| TW | 608268 U | 3/2021 | | |

OTHER PUBLICATIONS https://www.youtube.com/watch?v=wHnggFcYW-I by Hacker (Year: 2024).*
https://biaggi.com/products/zipsak-micro-fold-expandable-unseater-zipcube, Jul. 24, 2024.
https://biaggi.com/products/zipsak-boost-handbag-expands-to-travel-tote-3, May 28, 2024.

* cited by examiner

*Primary Examiner* — Don M Anderson
*Assistant Examiner* — Jessica Kavini Tamil
(74) *Attorney, Agent, or Firm* — Ashley D. Johnson; Dogwood Patent and Trademark Law

(57) ABSTRACT

The invention is a convertible bag that transitions from a first folded orientation configured as a handbag clutch. The clutch includes a flap with a removable interior flap portion. When the flap portions are separated, a portion of fabric is released and wrapped around the clutch. The interior flap portions are then rejoined to close the expanded bag configured as a shoulder bag. The clutch remains intact within the interior of the expanded bag. The interior of the expanded bag is configured to house a variety of items, such as shoes, sweaters, wraps, keys, and the like.

19 Claims, 18 Drawing Sheets

BAG CONVERTIBLE BETWEEN FOLDED AND UNFOLDED CONFIGURATIONS

FIELD OF THE INVENTION

The presently disclosed subject matter relates to a bag (e.g., handbag, purse, clutch) that is convertible between a first, folded orientation and a second, unfolded orientation with expandable material. The presently disclosed subject matter also includes methods of making and using the disclosed bag.

BACKGROUND OF THE INVENTION

People today live very busy lives, often running from work to a date or other evening engagement. For women in particular, this can cause many problems.

Specifically, depending upon the event or place the person is going, a different type or size of handbag may be needed. For example, a woman will often carry a larger and more neutral handbag for everyday use or while at work. For evening events, women often use a more decorative and/or smaller bag. Thus, a small clutch useful for a special event may not be ideal for use after the event While a woman could carry multiple purses, this can be cumbersome and impractical. Therefore, it would be desirable to provide a bag that can quickly and easily convert between a larger size and a smaller size that accommodates use in a variety of situations. In the first configuration (the folded configuration), the bag can be arranged as a relatively small clutch or handheld purse. In the second configuration (the unfolded configuration), the bag can be formed into a larger handbag for carrying bulky items (such as heels, clothing, etc.)

SUMMARY OF THE INVENTION

In some embodiments, the presently disclosed subject matter is directed to a bag comprising a front face and an opposed rear face, a top face and an opposed bottom face, and a pair of side faces. The bag includes a flap defined by a front flap and an opposed rear flap with a portion of material positioned therebetween in a flap interior, wherein the front and rear flaps are separable. The bag transitions between a first orientation and a second orientation. The first orientation is defined by the front and rear flaps joined together and holding the portion of material therebetween in the flap interior, the rear flap is in contact with the front face of the bag, and the front flap faces outward.

The second orientation is defined by separation of the front and rear flaps, such that the portion of material is released from the flap interior, the front flap is positioned adjacent to the rear face of the bag, and the portion of material extends around the rear face, bottom face, front face, top face and snaps in place. The rear flap is positioned to contact the front flap and faces outward.

In some embodiments, the front and rear flaps are releasably joined using a plurality of attachments selected from one or more snaps, hook and loop closures, buttons, magnets, clasps, fasteners, or ties.

In some embodiments, the front flap has a length, width, or both length and width that is 5-20 percent smaller than a length, width or both length and width of the rear flap.

In some embodiments, the material is selected from polyester, nylon, wool, cotton, silk, leather, faux leather, suede, faux suede, denim, twill, tweed, bamboo, rayon, fleece, burlap, flannel, canvas, lace, sateen, corduroy, linen, velvet, spandex, jersey, terrycloth, velour, felt, or combinations thereof.

In some embodiments, the material is attached to the front and rear flaps using sewing, adhesive, fasteners, clips, zippers, or combinations thereof.

In some embodiments, the material has a length, width, or both length and width of about 10-50 inches.

In some embodiments, the bag has a length of 6-25 inches, a length of height of 3-12 inches, and a thickness of 1-6 inches in the first orientation.

In some embodiments, the bag has a length of 10-50 inches and a height of 10-50 inches in the second orientation.

In some embodiments, the bag includes a pair of releasably connectors, a first connector positioned on the front face of the bag and a second connector positioned on the flap, wherein the first and second connectors align.

In some embodiments, the flap includes a seam pivot point adjacent to the top face of the bag.

In some embodiments, the interior includes a first pouch positioned adjacent to the front face and a second pouch adjacent to the rear face.

In some embodiments, the joined rear and front flaps are configured to rotate from the front face to the rear face via the seam pivot point.

In some embodiments, the bag includes one or more attachment points configured for the attachment of one or more handles or straps.

In some embodiments, the presently disclosed subject matter is directed to a method of transitioning a bag between a first orientation and a second orientation.

Particularly, the method comprises rotating the flap of the disclosed bag in the first orientation such that the front flap contacts the rear face. The method includes separating the front and rear flaps, thereby releasing the material from the flap interior. The method includes rotating the front flap around the rear face, bottom face, front face, and top face of the bag, such that the material wraps around the exterior of the bag. The method includes joining the front flap to the rear flap positioned on the rear face of the bag, wherein the second orientation is achieved.

In some embodiments, the steps can be reversed to convert the bag from the second orientation to the first orientation.

DETAILED DESCRIPTION OF THE INVENTION

Figure 1A:
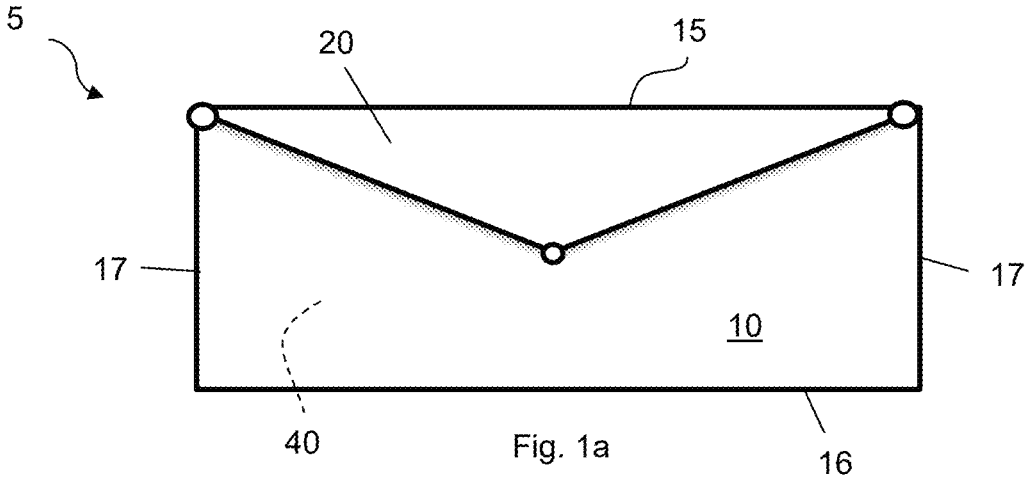
FIG. 1*a* is a front plan view of a convertible bag in a first folded orientation in accordance with some embodiments of the presently disclosed subject matter.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments+/−20%, in some embodiments+/−10%, in some embodiments+/−5%, in some embodiments+/−1%, in some embodiments+/−0.5%, and in some embodiments+/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skills in the art to which this disclosure belongs.

The presently disclosed subject matter is directed to a bag that quickly and easily converts between a relatively small handbag (e.g., clutch) and a larger bag (e.g., shoulder bag). The term "handbag" or "bag" generally refers to any type of receptacle for holding one or more items, such as (but not limited to) money, wallet, shoes, daily planner, phone, and the like. Thus, a bag can include a purse, tote bag, shoulder bag, clutch, and the like. The term "clutch" includes any of a variety of small handbags configured without a handle. The term "tote bag" refers to a large bag with one or more handles that support the weight of the bag and any item contained within the tote interior. The term "shoulder bag" refers to any bag that includes one or more straps or handles that can be positioned over the shoulder of a user during use.

Figure 1B:
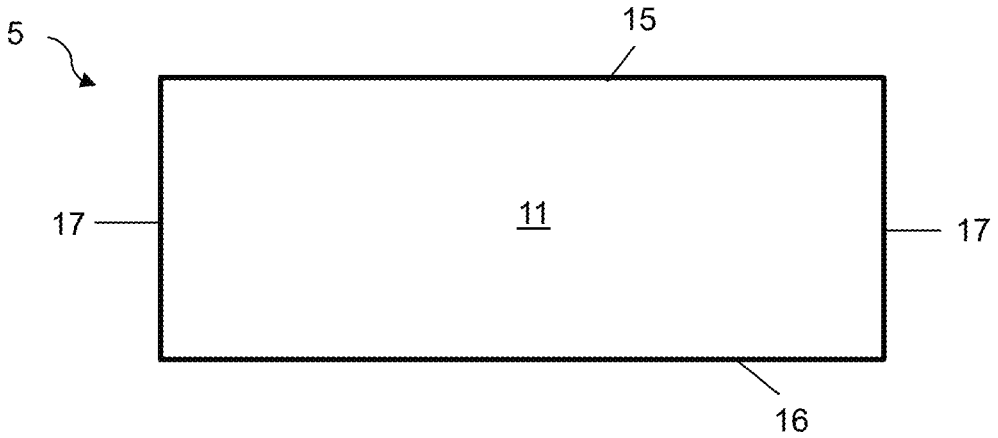
FIG. 1*b* is a rear plan view of the bag of FIG. 1*a* in accordance with some embodiments of the presently disclosed subject matter.
Figure 1C:
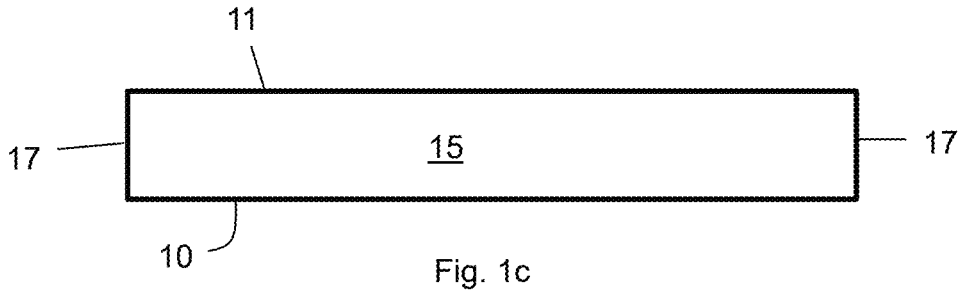
FIG. 1*c* is a top plan view of the bag of FIG. 1*a* in accordance with some embodiments of the presently disclosed subject matter.

Advantageously, the disclosed bag can convert between first and second configurations to give the user versatility during use. In the first configuration (the folded configuration), the bag can be arranged as a relatively small clutch or handheld purse. In the second configuration (the unfolded configuration), the bag can be formed into a larger handbag for carrying bulky items (such as shoes, clothing, etc.). FIGS. 1*a*-1*c* illustrate front, rear, and top views, respectively, of one embodiment of bag 5 comprising front face and opposed rear face 11, top face 15 and opposed bottom face 16, with a pair of side faces 17.

Figure 2A:
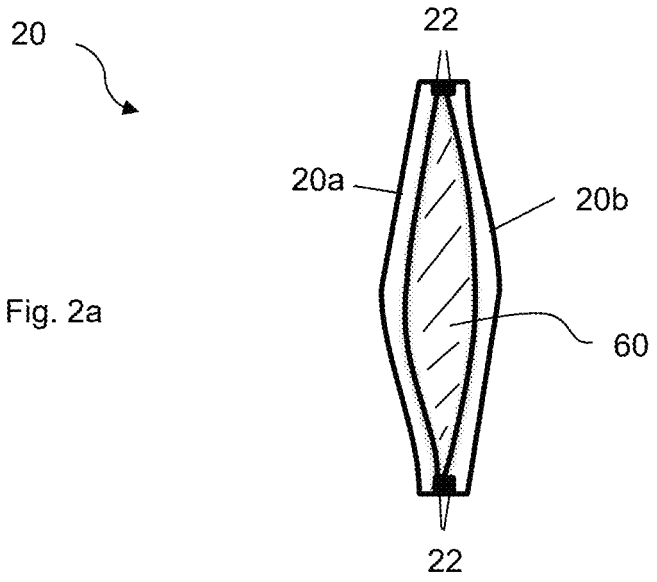
FIG. 2*a* is a side plan view of a bag flap in accordance with some embodiments of the presently disclosed subject matter.
Figure 2B:
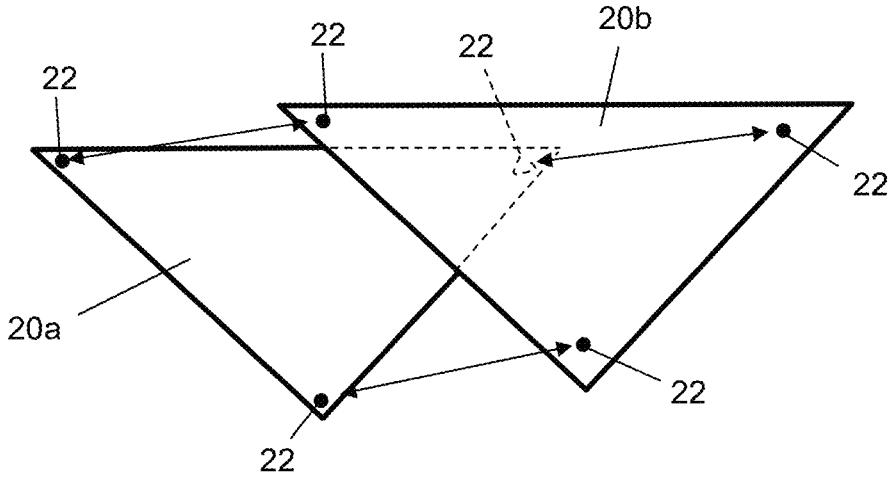
FIG. 2*b* is a front view illustrating front and rear flaps in accordance with some embodiments of the presently disclosed subject matter.

The bag also includes flap 20 that folds open to access bag interior 40. FIGS. 2*a* and 2*b* illustrate one embodiment of flap 20 comprising front flap 20*a* and rear flap 20*b* that are releasably joined together using one or more attachments 22. Attachments 22 can include any element, such as (but not limited to) snaps, VELCRO®, buttons, magnets, clasps, fasteners, ties, and the like. As illustrated, the flap separates into front and rear flaps 20*a* and 20*b* with a portion of fabric positioned therebetween during conversion to the second configuration. The fabric is attached to both the front flap and the rear flap to create the larger unfolded bag as described in detail below.

Flap 20 can be configured in any desired shape and is not limited to the triangular shape shown in the Figures. Thus, the flap can have a square, rectangular, circular, oval, triangular, etc. shape.

In some embodiments, front flap 20*a* can be of the same shape as the front flap but configured to be slightly smaller in length and/or width (e.g., about 5, 10, 15, or 20 percent smaller). In other embodiments, the front and rear flaps can be configured in the same or about the same size.

The front and rear flaps can be constructed from any suitable material, such as (but not limited to) plastic, leather, suede, cotton, denim, or combinations thereof. Any material can be used.

Figure 2C:
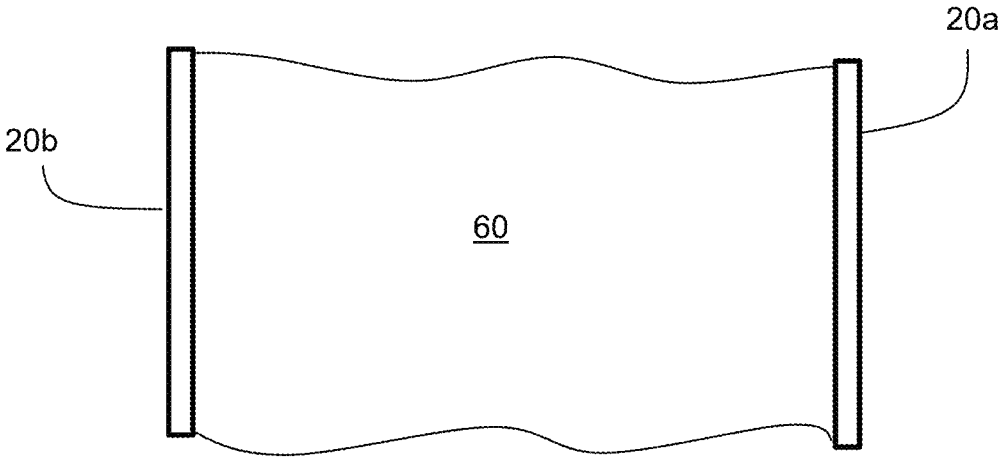
FIG. 2*c* is a side plan view of front and rear flaps with fabric attached therebetween in accordance with some embodiments of the presently disclosed subject matter.

Fabric 60 is positioned between the front and rear flaps, attached to an interior surface thereof, as shown in FIG. 2*c*. The term "fabric" refers to any knitted, woven, or nonwoven material. Suitable fabrics can include (but are not limited to) polyester, nylon, wool, cotton, silk, leather, faux leather, suede, faux suede, denim, twill, tweed, bamboo, rayon, fleece, burlap, flannel, canvas, lace, sateen, corduroy, linen, velvet, spandex, jersey, terrycloth, velour, felt, or combinations thereof. In some embodiments, the fabric is constructed from a flexible material that allows the fabric to fold over and around the clutch, as described below. A "flexible" material refers to the ability of a material to withstand stress in the nature of bending, stretching, compressing, and/or twisting without breaking or cracking.

The fabric can be attached to the front and rear flaps using any conventional mechanism, such as sewing, adhesive, fasteners, clips, zippers, and the like.

Figure 3:
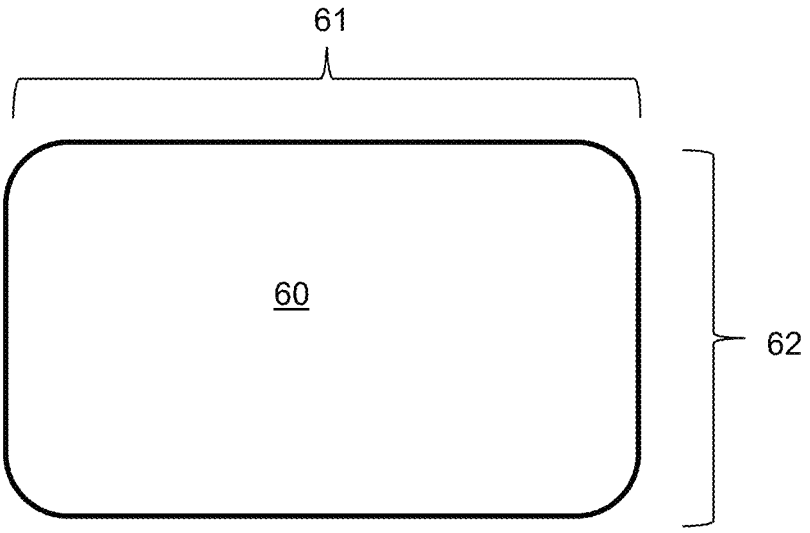
FIG. 3 illustrates a portion of fabric in accordance with some embodiments of the presently disclosed subject matter.

In some embodiments, bag 5 can include a portion of fabric 60 with a length 61 and/or width 62 of about 10-50 inches, as shown in FIG. 3. Thus, the fabric can include a length and/or width of at least/no more than about 10, 15, 20, 25, 30, 35, 40, 45, or 50 inches. The fabric can also include a thickness of less than about 0.5 inches (e.g., at least/nor more than about 0.1, 0.2, 0.3, 0.4, or 0.5 inches). However, the presently disclosed subject matter is not limited and fabric with any dimensions can be used.

Figure 4A:
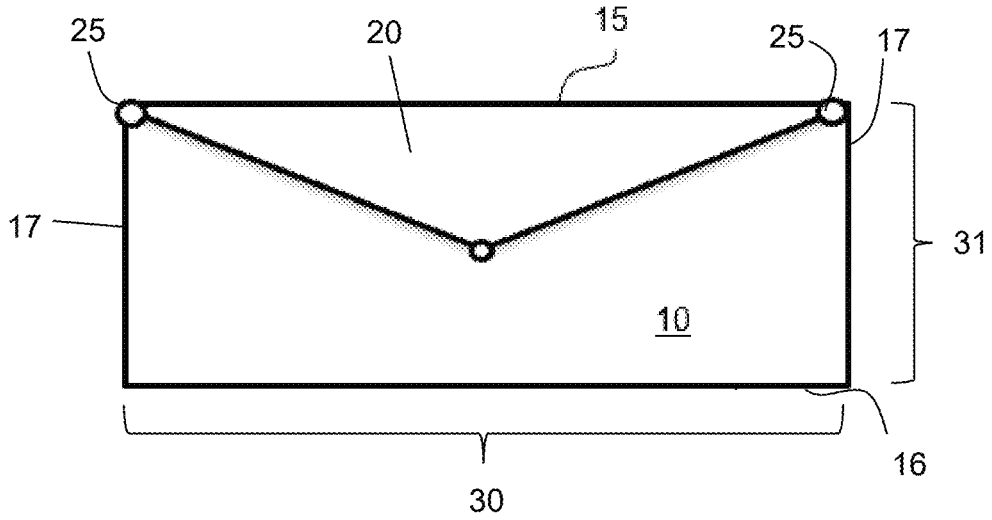
FIG. 4*a* is a front plan view of a convertible bag in a first folded orientation in accordance with some embodiments of the presently disclosed subject matter.

Bag 5 can have any desired dimensions in the first (folded) orientation, such as length 30 of about 11 inches (e.g., at least/no more than about 6, 7, 8, 9, 10, 11, 12, 13, 14, 15, 16, 17, 18, 19, 20, 21, 22, 23, 24, or 25 inches). The term "length" refers to the longest straight line segment between side faces 17, as shown in FIG. 4*a*. The bag can also include height 31 of about 5 inches (e.g., at least/no more than about 3, 4, 5, 6, 7, 8, 9, 10, 11, or 12 inches). The term "height" refers to the longest straight line distance between top and bottom faces 15, 16, as shown in FIG. 4*a*.

Figure 4B:
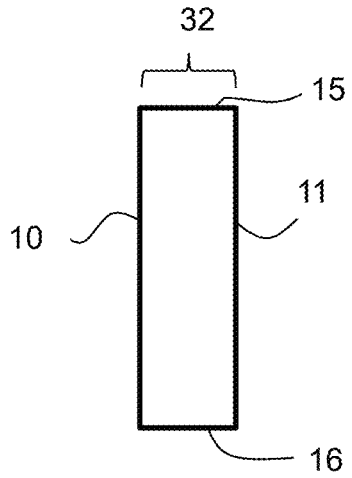
FIG. 4*b* is a side plan view of the convertible bag of FIG. 4*a* in accordance with some embodiments of the presently disclosed subject matter.

The bag also includes width 32 of about 2 inches (e.g., at least/no more than about 1, 1.5, 2, 2.5, 3, 3.5, 4, 4.5, 5, 5.5, or 6 inches). The term "width" refers to the longest straight line distance between front face 10 and rear face 11, as illustrated in FIG. 4*b*.

It should be appreciated that the dimensions of bag 5 in the first configuration are not limited and can be configured larger or smaller than the length, width, and thickness ranges given herein.

Bag 5 can be constructed from any suitable material, such as (but not limited to) leather, suede, fabric, plastic, or combinations thereof.

Figure 5A:
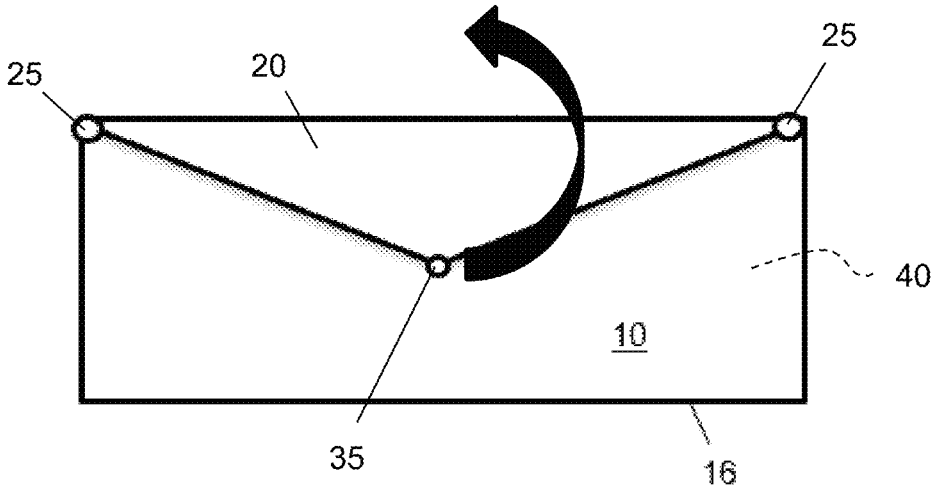
FIGS. 5*a* and 5*b* are front plan views of a convertible bag transitioning from a first folded orientation to a second unfolded orientation in accordance with some embodiments of the presently disclosed subject matter.
Figure 5B:
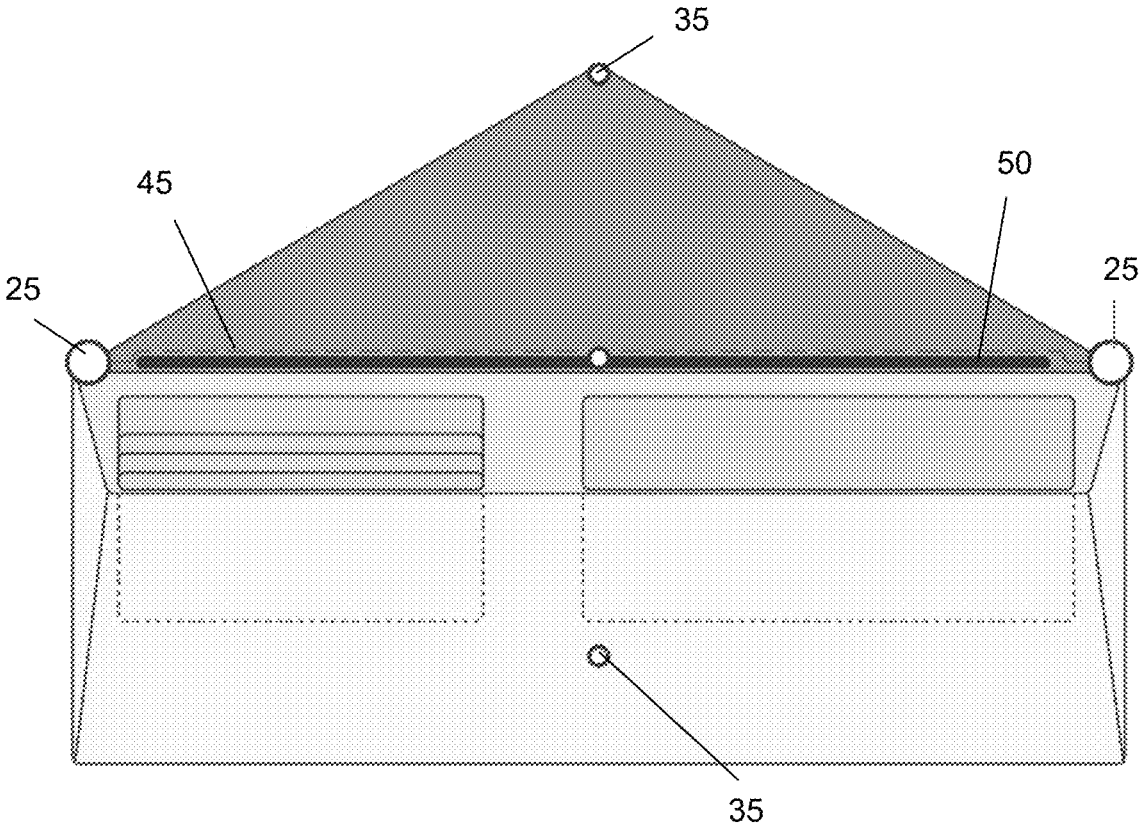

As shown in FIG. 5*a*, in the first orientation flap 20 covers a portion of front face 10 of the bag. In some embodiments, the flap is releasably adhered to the front face of the bag using connectors 35. One connector is positioned on the front face of the bag that aligns with a second connector on the flap. Connectors 35 can include any connecting elements, such as (but not limited to) magnets, clasps, buttons, VELCRO®, fasteners, clips, or combinations thereof. Flap 20 therefore secures closure of the bag in the first configuration when it is being used as a small purse or clutch. Upon the application of light pressure, connectors 35 release, allowing the flap to rotate upwards as shown in FIG. 5*b*. The fastener is strong enough to maintain the cover in the folded configuration but can be easily disengaged for transitioning to the unfolded configuration using the application of light pressure. When the flap is in the opened configuration of FIG. 5*b*, a user can therefore access credit cards, a phone, and the like positioned within the bag interior.

The junction between the flap and the top of the bag in the first orientation includes seam 45 that functions as a pivot line, allowing the flap to move upward and downward, toward and away from the front face and/or rear face of the bag as desired by the user. Seam 45 can be a stitched seam, allowing for secure movement of the flap. The stitched seam is reinforced and runs along the center of the bag as shown, facilitating the ability of the two halves of the flap to pivot and collapse into a compact form. The bag also includes a pair of hidden pouches 50 that can house thin sandals and a handbag strap The pouches are positioned directly adjacent to the front face of the pouch or directly adjacent to the rear face of the pouch, as shown in FIG. 5*c*.

Figure 5C:
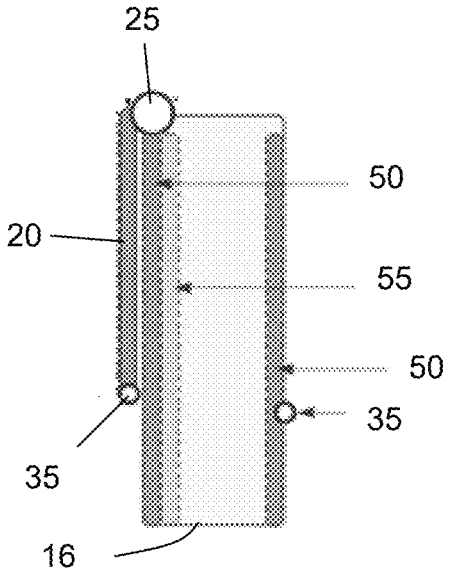
FIG. 5*c* is a side plan view of a convertible bag transitioning from a first folded orientation to a second unfolded orientation in accordance with some embodiments of the presently disclosed subject matter.

FIG. 5*c* illustrates that flap 20 can be fully rotated from the front face 10 of the bag to contact rear face 11 of the bag. Such folding is accomplished by the flexibility provided by seam 45. Specifically, the seam and pivot line function to guide the bag during folding and unfolding. When in the first orientation, the seam and pivot line collapse neatly. When in the second orientation, the seam and pivot line facilitate the smooth separation of the front and rear flaps 20*a* and 20*b*. Thus, the second orientation provides a full sized bag with an expanded interior compartment, while the use of the attachment points 22 ensures that the bag maintains its structure and functionality in both the open and closed configurations.

The bag also includes a pair of attachment points 25 configured as reinforced connection points positioned inside the bag in the folded orientation for optional connection of a detachable shoulder strap. The attachment points are configured to withstand the forces associated with carrying the bag over the shoulder in the second unfolded orientation while also maintaining structural integrity. The attachment points can include any configuration, such as loops, fasteners, clips, and the like that accommodate connection to one or more straps and/or handles.

Figure 5D:
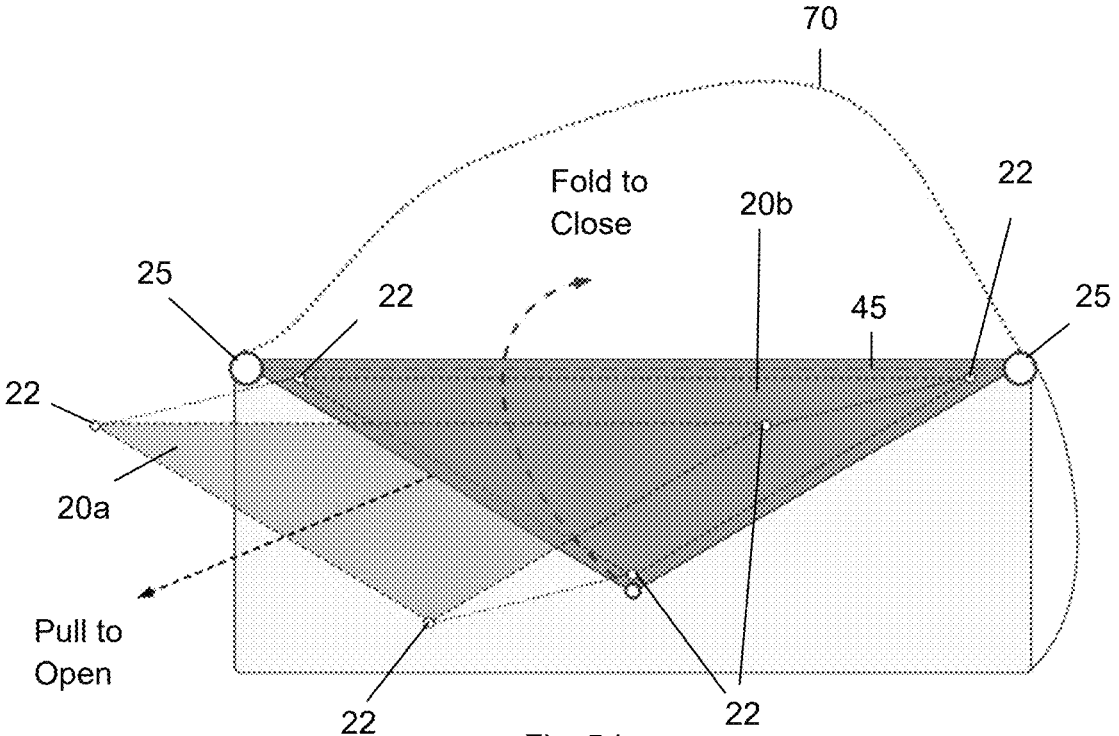
FIG. 5*d* is a back plan view of a convertible bag front and rear flap portions separating during transition from a first folded orientation to a second unfolded orientation in accordance with some embodiments of the presently disclosed subject matter.
Figure 6A:
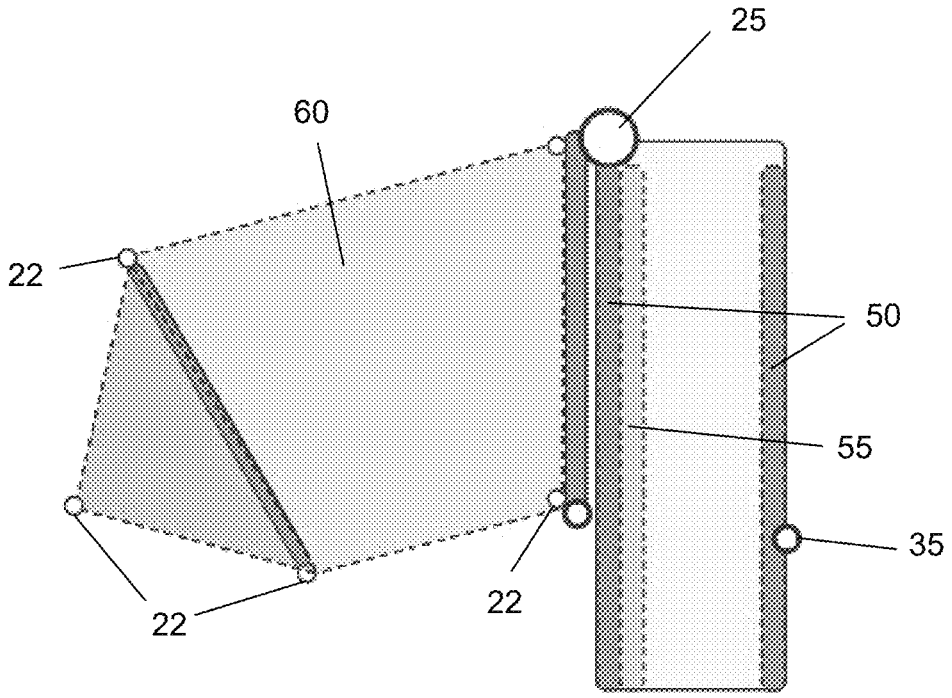
FIGS. 6*a*-6*c* illustrate side plan views of a convertible bag transitioning from a first folded orientation to a second unfolded orientation in accordance with some embodiments of the presently disclosed subject matter.
Figure 6B:
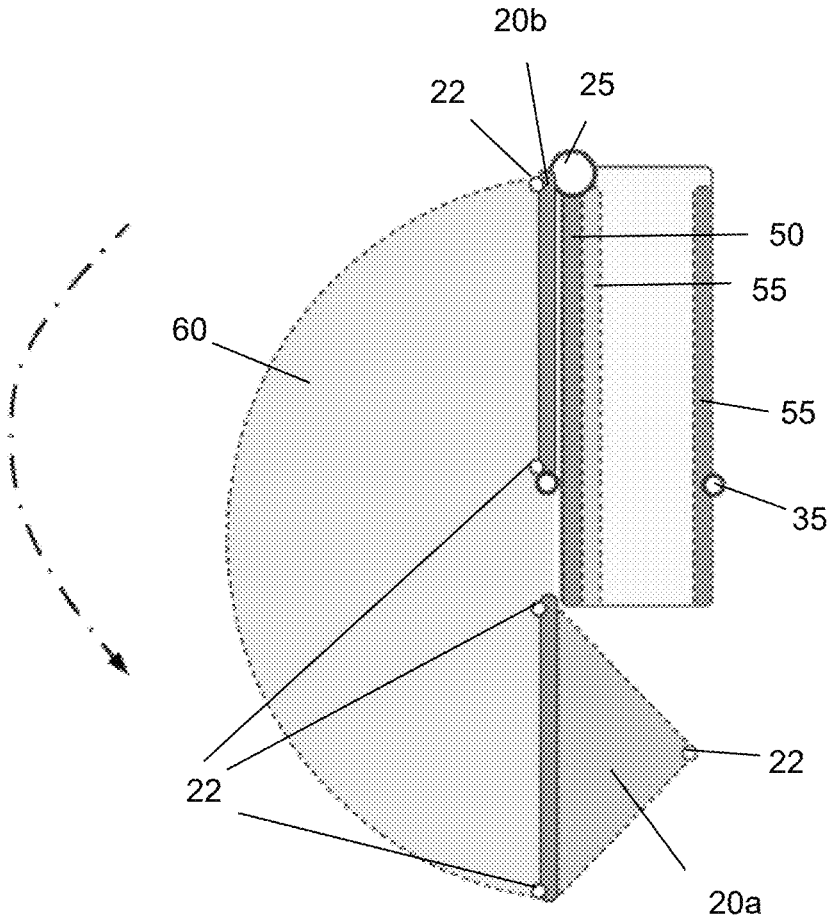
Figure 7A:
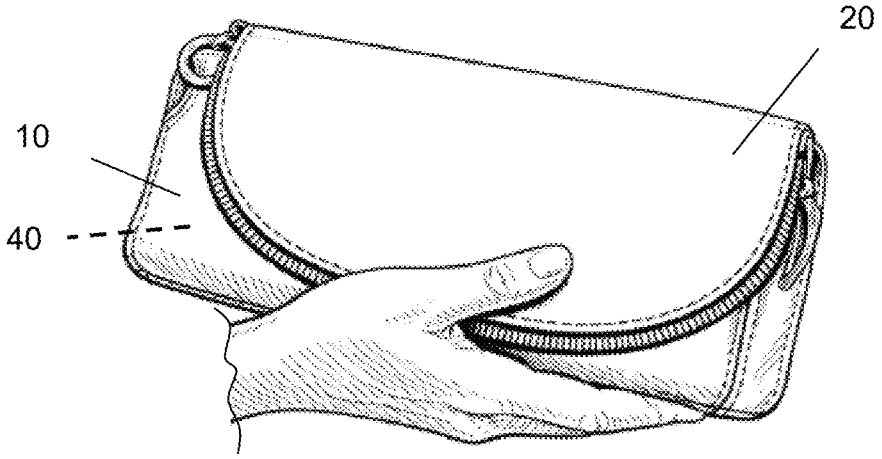
FIGS. 7*a*-7*i* are perspective views illustrating a convertible bag transitioning from a first folded orientation to a second unfolded orientation in accordance with some embodiments of the presently disclosed subject matter.
Figure 7B:
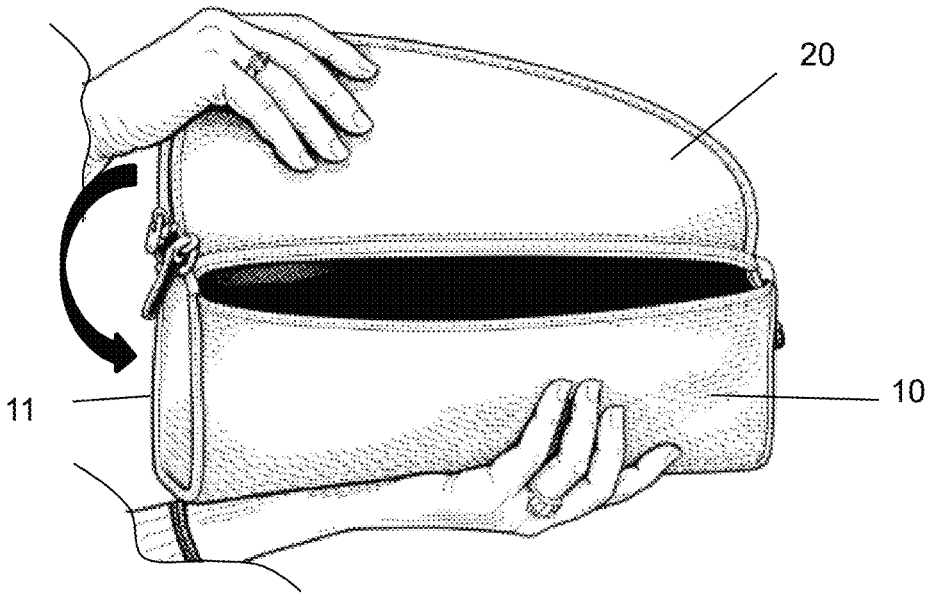
Figure 7C:
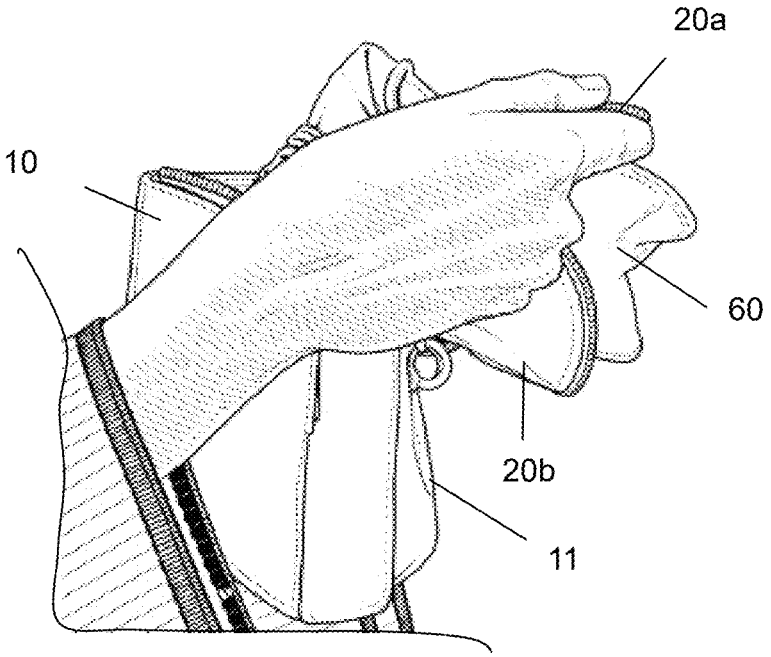
Figure 7D:
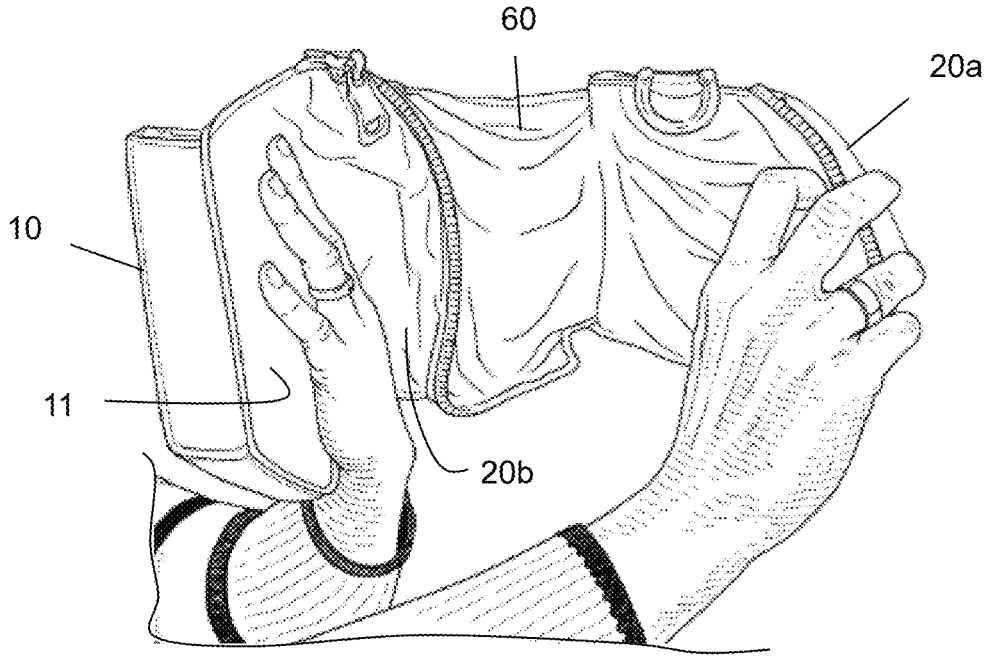
Figure 7E:
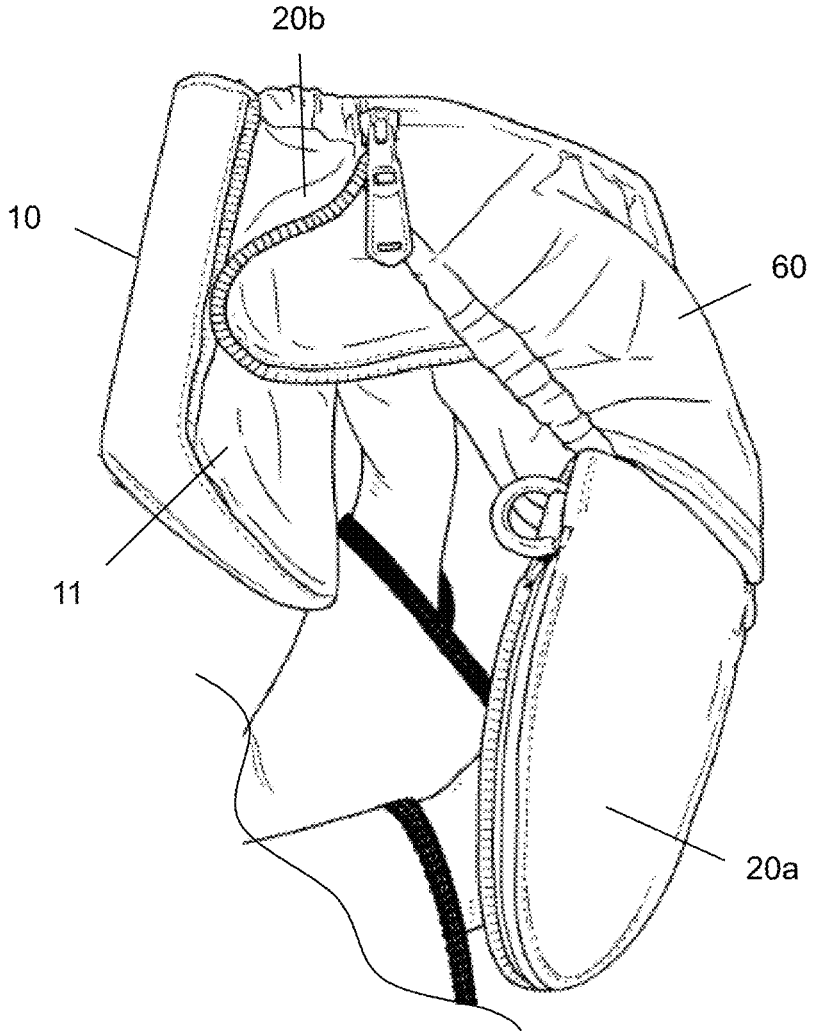
Figure 7F:
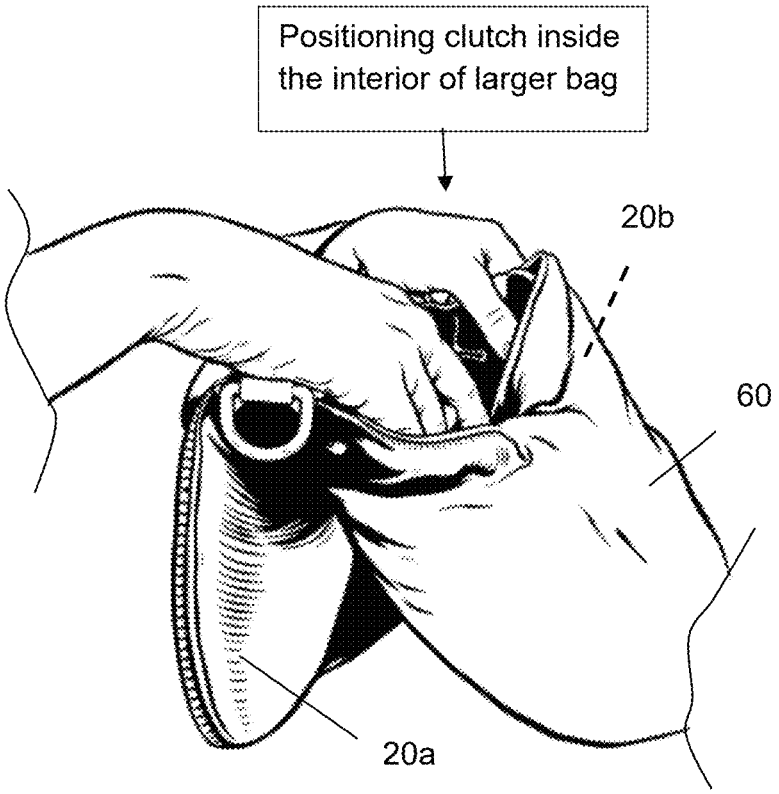
Figure 7G:
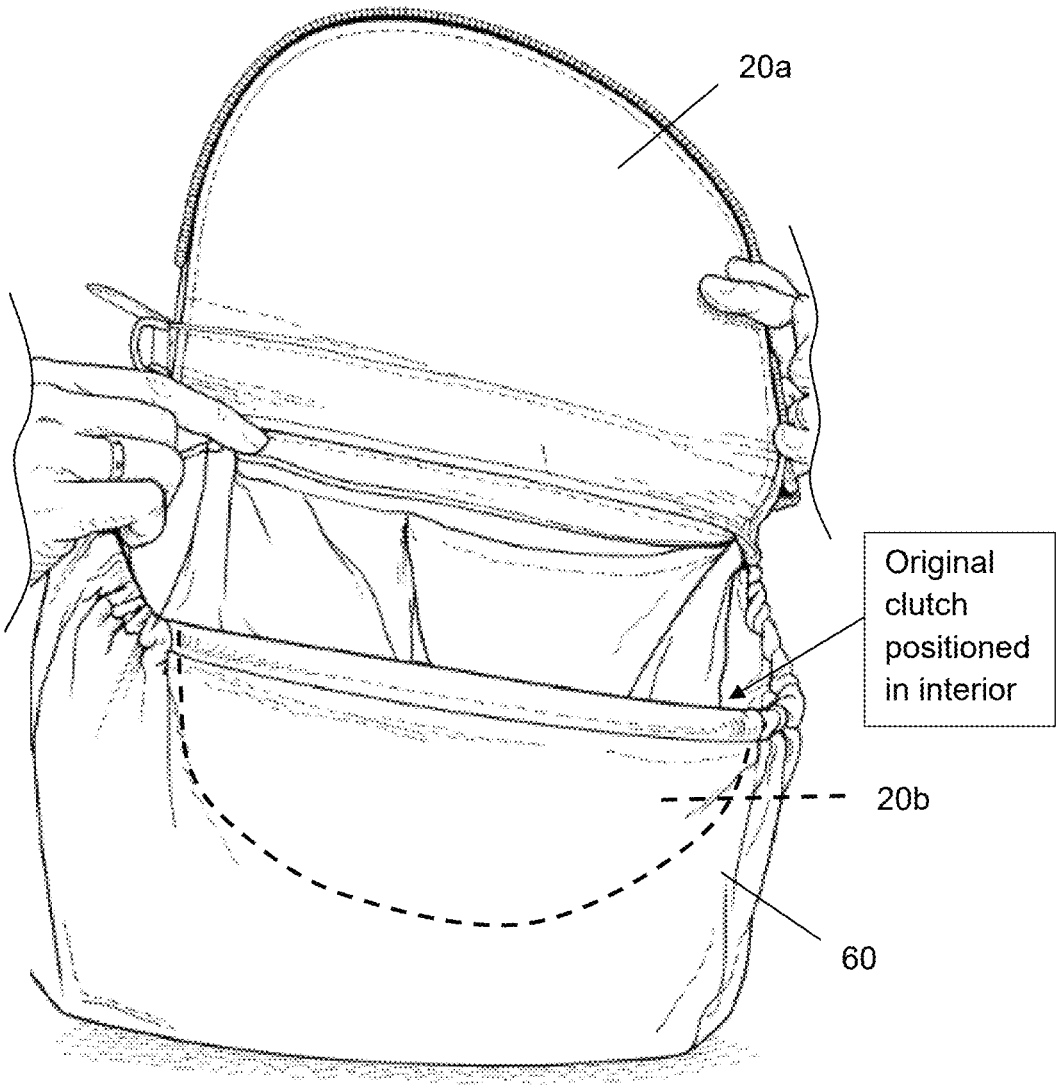
Figure 7H:
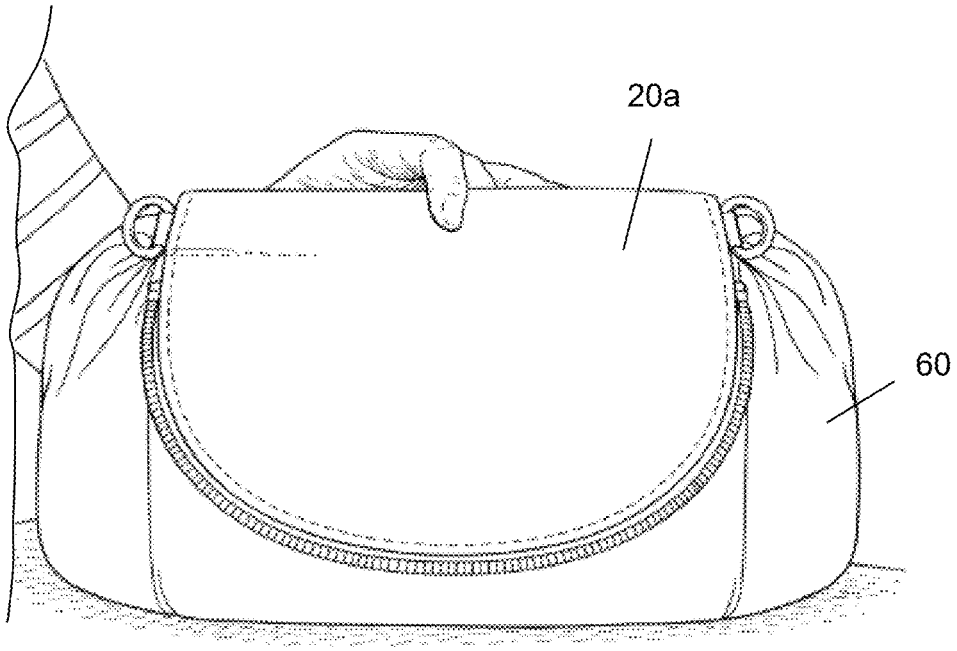

To transition the bag from the first configuration of FIG. 7*a* to the second (e.g., unfolded configuration), flap 20 is first rotated from contact with front face 10 of the bag to rear face 11, as shown in FIG. 5*c* and as illustrated by the arrow in FIG. 7*b*. Specifically, when the flap is rotated, the rear flap 20*b* will pivot to contact rear face 11. Front flap 20*a* is releasably separated from rear flap 20*b* by applying light pressure to attachments 22, as shown in FIG. 5*d* or by unzipping as shown in FIG. 7*c*. The attachments therefore facilitate the separation of the front and rear flaps, allowing stored material to be released from the inside flap, transitioning into the unfolded orientation of the full shoulder bag. FIG. 6*a* illustrates a left side view of the bag open with flap 20 folded over and the bag exposed. As shown in FIGS. 6*a* and 7*d*, when front flap 20*a* is released from rear flap 20*b* by applying light pressure to attachment points 22, material 60 is then unfolded and exposed. As the front flap is rotated below the bottom face of the bag as shown in FIG. 6*b* and FIG. 7*e*, the folded configuration transitions into the unfolded configuration. The clutch portion is then retained within the interior of the expanded bag as shown in FIGS. 7*g* and 7*h*. Thus, the bag is transformed from a compact clutch to an expanded shoulder bag with a form of elastic material to help expanded material hug clutch. Pouches 50 maintain a compact form until the bag is fully unfolded. However, accessories 55 are accessible and retain their function as the bag unfolds. In this way, small items can be securely stored and reachable during the transition process.

Further, connector 35 positioned on the front face of the bag that secures the bag in the closed position remains in place during the transition, preventing the bag from accidentally opening while the user manipulates attachment points 22.

Figure 6C:
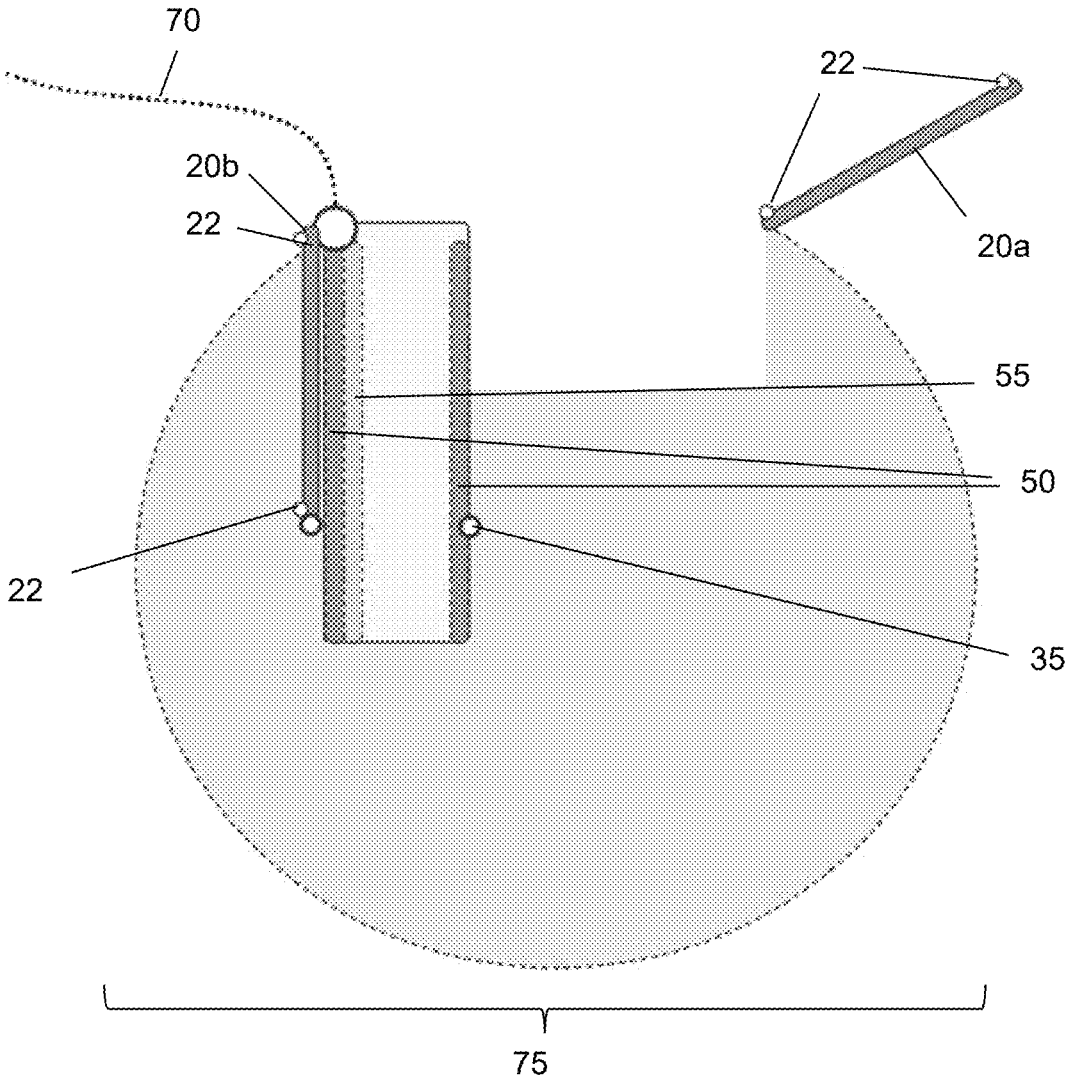
Figure 7I:
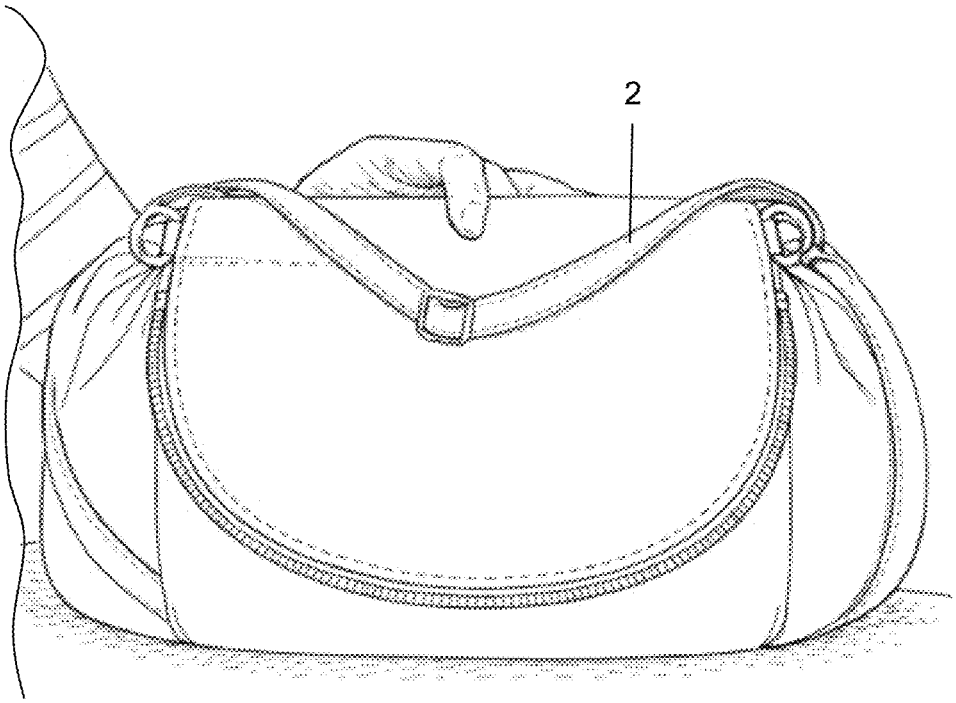

FIG. 6*c* illustrates the end of the transition of the bag to the second orientation (e.g., unfolded). As shown, the bag is fully opened and ready for use in the full size (e.g., expanded) form as also shown in FIG. 7*h*. Optionally a strap 2 can be added to the full sized bag for carrying the bag as shown in FIG. 7*i*. Attachment points 22 are responsible for maintaining the structure and stability of the bag once it has been unfolded and expanded. Specifically, the attachment points again join the front and rear flaps. Pouches 55 are fully exposed and accessible to a user in the expanded orientation. Connectors are not in use in the unfolded configuration but remain available for use when the bag is folded back to the first orientation. The second configuration provides the user with a fully functional shoulder bag, with a large internal compartment and organized pouches for smaller items.

Figure 6D:
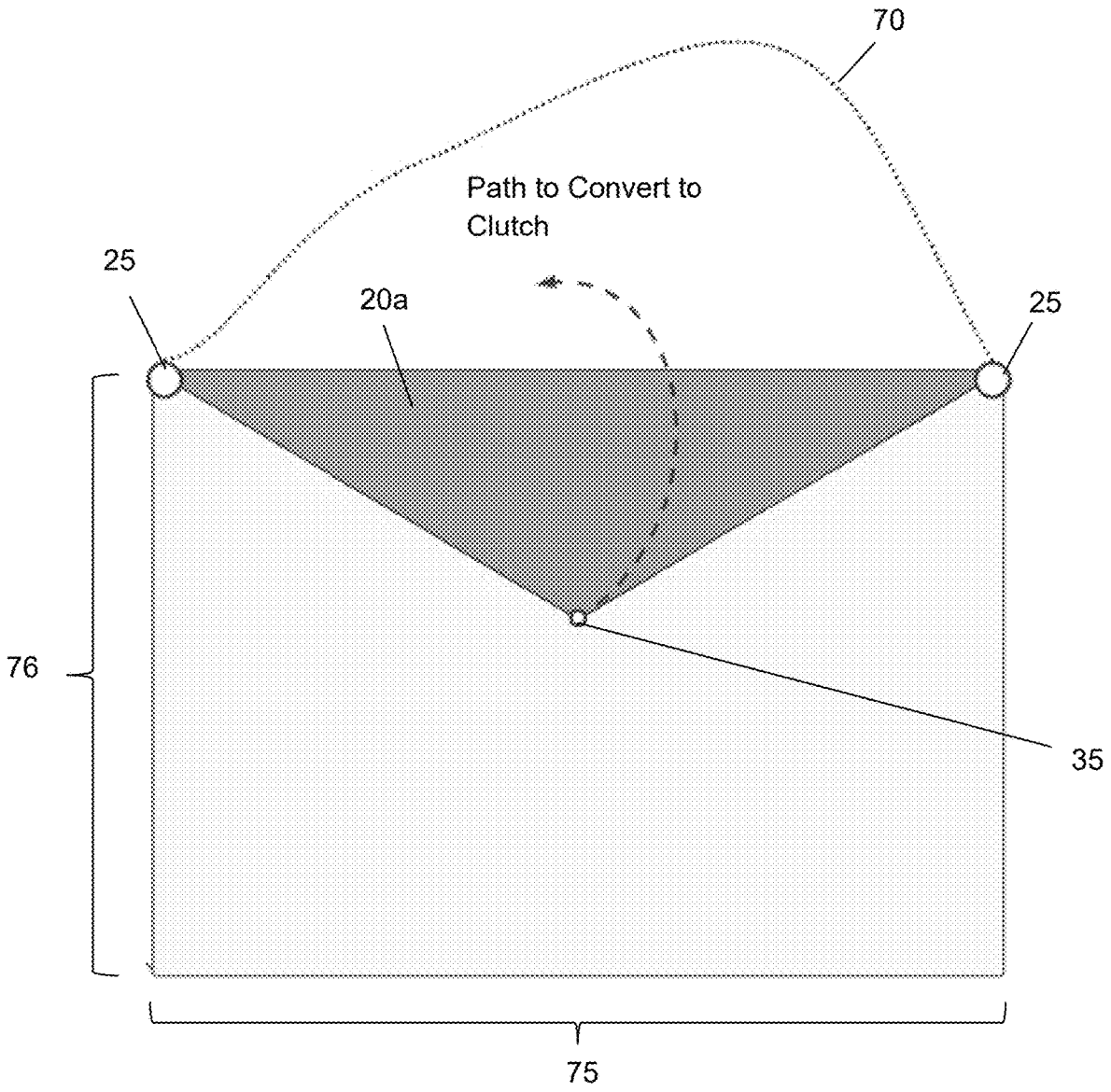
FIG. 6*d* is a front plan view of a convertible bag in a second unfolded orientation in accordance with some embodiments of the presently disclosed subject matter.

FIG. 6*d* illustrates a front view of the fully expanded bag in the second configuration with the front and rear flaps again rejoined together via attachments 22. As shown, a shoulder strap 70 can optionally be connected to attachment points 25, allowing a user to carry the expanded bag by the strap and/or over the shoulder. Front flap 20*a* serves as the exterior surface of the bag in the second configuration, providing structure and shape to the expanded form. However, the expanded bag can be worn in any desired way, such as around the neck, across the body, or in a backpack-like manner.

The expanded orientation of the bag can have any desired dimensions, such as length 75 of about 10-50 inches (e.g., at least/no more than about 10, 15, 20, 25, 30, 35, 40, 45, or 50 inches). Similarly, the expanded bag can have height 76 of about 5-50 inches (e.g., at least/no more than about 5, 10, 15, 20, 25, 30, 35, 40, 45, or 50 inches. The expanded bag can also have width 77 of about 10-50 inches (e.g., at least/no more than about 10, 15, 20, 25, 30, 35, 40, 45, or 50 inches). It should be appreciated that the dimensions of the expanded bag are not limited to the ranges given above.

Figure 6E:
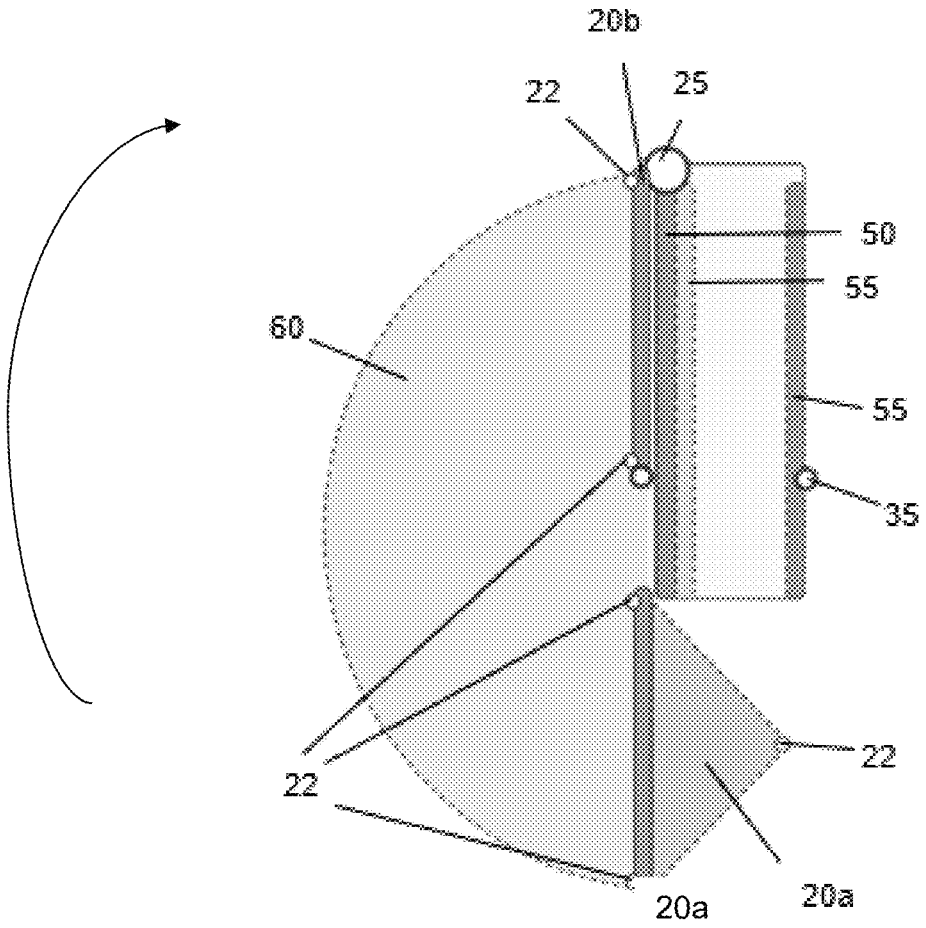
FIG. 6*e* is a side plan view of a convertible bag transitioning from a second configuration to a first folded configuration.

To transition bag 5 from the second expanded configuration to the first folded configuration, the noted steps above are simply reversed. Thus, the rear and front flaps are separated, and the front flap is then rotated upward as shown in FIG. 6*d*. The front flap is then rotated beneath the bag as shown in FIG. 6*e* until it contacts front flap 20*a*, as shown in the embodiment of FIG. 5*c*. Material 60 is then folded between the front and rear flaps for later use. The joined flap can then be rotated to contact front face 10 of the bag (e.g., clutch) in the first configuration as illustrated in FIG. 4*a*.

The disclosed bag offers many advantages over prior art bags. For example, the foldable characteristic of the bag and bag flap 20 allows for efficient space utilization. Thus, bag 5 can be used as a slim hand held clutch in the first orientation, while also easily transitioning to a larger shoulder bag in an second orientation if desired.

The disclosed bag can be used to carry items after use, such as shoes. For example, the folded clutch configuration can be used at an event. After the event, the bag can be converted to the unfolded configuration where the user's shoes can be swapped for flats. Other items can also be stowed within the expanded bag interior, which can be conveniently worn as a shoulder bag.

Bag 5 is easy to use, such that even children or the elderly would be able to easily and effectively transition between the first folded and second unfolded configurations of the bag.

Bag 5 saves users time in removing all items and transferring from one handbag to another. Instead a single bag 5 can be used to safely and effectively stow smaller items, as well as larger items (such as shoes).

The disclosed bag further provides a cost savings by avoiding the purchase of multiple individual bags.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A bag comprising:

a front face and an opposed rear face, a top face and an opposed bottom face, and a pair of side faces;

a flap defined by a front flap and an opposed rear flap with a portion of material positioned therebetween in a flap interior, wherein the front and rear flaps are separable;

a pair of releasable connectors, a first connector positioned on the front face of the bag and a second connector positioned on the flap, wherein the first and second connectors align;

wherein the bag transitions between a first orientation and a second orientation, the first orientation defined by the front and rear flaps joined together and holding the portion of material therebetween in the flap interior, and the rear flap is in contact with the front face of the bag and the front flap faces outward;

wherein the second orientation is defined by separation of the front and rear flaps, such that the portion of material is released from the flap interior, the front flap is positioned adjacent to the rear face of the bag, and the portion of material extends around the front face, rear face, top face, bottom face, and side faces of the bag, and wherein the rear flap is positioned to contact the front flap and faces outward;

wherein the bag is configured for use as a handheld bag in the first orientation and a comparatively larger bag with an expanded interior in the second orientation.

2. The bag of claim 1, wherein the front and rear flaps are releasably joined using a plurality of attachments selected from one or more snaps, hook and loop closures, buttons, magnets, clasps, fasteners, or ties.

3. The bag of claim 1, wherein the front flap has a length, width, or both length and width that is 5-20 percent smaller than a length, width or both length and width of the rear flap.

4. The bag of claim 1, wherein the material is selected from polyester, nylon, wool, cotton, silk, leather, faux leather, suede, faux suede, denim, twill, tweed, bamboo, rayon, fleece, burlap, flannel, canvas, lace, sateen, corduroy, linen, velvet, spandex, jersey, terrycloth, velour, felt, or combinations thereof.

5. The bag of claim 1, wherein the material is attached to the front and rear flaps via sewing, adhesive, fasteners, clips, zippers, or combinations thereof.

6. The bag of claim 1, wherein the material has a length, width, or both length and width of about 10-50 inches.

7. The bag of claim 1, with a length of 6-25 inches, a length of height of 3-12 inches, and a thickness of 1-6 inches in the first orientation.

8. The bag of claim 7, with a length of 10-50 inches and a height of 10-50 inches in the second orientation.

9. The bag of claim 1, wherein the flap includes a seam pivot point adjacent to the top face of the bag.

10. The bag of claim 9, wherein the joined rear and front flaps are configured to rotate from the front face to the rear face via the seam pivot point.

11. The bag of claim 1, wherein the interior includes a first pouch positioned adjacent to the front face and a second pouch adjacent to the rear face.

12. The bag of claim 1, further comprising one or more attachment points configured for the attachment of one or more handles or straps.

13. A method of transitioning a bag between a first orientation and a second orientation, the method comprising:

rotating the flap of the bag of claim 1 in the first orientation such that the front flap contacts the rear face;

separating the front and rear flaps, thereby releasing the material from the flap interior;

rotating the front flap around the rear face, bottom face, front face, and top face of the bag, such that the material wraps around the exterior of the bag;

joining the front flap to the rear flap positioned on the rear face of the bag, wherein the second orientation is achieved.

14. The method of claim 13, wherein the steps can be reversed to convert the bag from the second orientation to the first orientation.

15. The method of claim 13, wherein the front and rear flaps are releasably joined using a plurality of attachments selected from one or more snaps, hook and loop closures, buttons, magnets, clasps, fasteners, or ties.

16. The method of claim 13, wherein the front flap has a length, width, or both length and width that is 5-20 percent smaller than a length, width or both length and width of the rear flap.

17. The method of claim 13, wherein the bag has a length of 6-25 inches, a length of height of 3-12 inches, and a thickness of 1-6 inches in the first orientation.

18. The method of claim 13, wherein the bag has a length of 10-50 inches and a height of 10-50 inches in the second orientation.

19. The method of claim 13, further comprising attaching one or more handles or straps to one or more attachment points configured on the bag.

* * * * *